US007381070B2

(12) United States Patent
Foo

(10) Patent No.: US 7,381,070 B2
(45) Date of Patent: Jun. 3, 2008

(54) SAFETY LAMPHOLDER AND METHOD FOR AVOIDING ACCIDENTAL ELECTRIC SHOCK CAUSED BY LAMPHOLDER

(75) Inventor: Onn Fah Foo, Hong Kong (HK)

(73) Assignee: Mass Technology (H.K.) Ltd., Kowloon (HK)

( * ) Notice: Subject to any disclaimer, the term of this patent is extended or adjusted under 35 U.S.C. 154(b) by 0 days.

(21) Appl. No.: 11/653,378

(22) Filed: Jan. 16, 2007

(65) Prior Publication Data

US 2007/0167050 A1 Jul. 19, 2007

(30) Foreign Application Priority Data

Jan. 18, 2006 (CN) ..... 2006 1 0005458

(51) Int. Cl.
*H01R 29/00* (2006.01)

(52) U.S. Cl. ..... 439/188; 439/419; 200/51.09

(58) Field of Classification Search ..... 439/188, 439/419; 200/51.09, 51 R, 51.11
See application file for complete search history.

(56) References Cited

U.S. PATENT DOCUMENTS 3,843,854 A * 10/1974 Mori et al. ..... 200/51.09
3,915,536 A * 10/1975 Glantz ..... 439/188
5,030,124 A * 7/1991 Lorentzon ..... 439/188
5,595,493 A * 1/1997 Chen ..... 439/188
5,743,758 A * 4/1998 Cheng et al. ..... 439/419
5,951,313 A * 9/1999 Arimoto ..... 439/188
5,980,304 A * 11/1999 Lin ..... 439/419

FOREIGN PATENT DOCUMENTS

| | | |
|---|---|---|
| CN | ZL91215869.7 | 4/1992 |
| CN | ZL93226038.1 | 5/1994 |
| CN | ZL93225663.5 | 6/1994 |
| WO | WO2005/006503 | 1/2005 |

* cited by examiner

*Primary Examiner*—Gary F. Paumen
(74) *Attorney, Agent, or Firm*—Rabin & Berdo, P.C.

(57) ABSTRACT

A safety lampholder is disclosed, comprising an insulating housing; an insulating or electrically conductive lamp socket placed within one end of the housing; an electrically shockproof means fully integrated within another end of the housing, wherein the shockproof means comprises two electrical connectors electrically coupled to a power supply; two electrical contactors in direct contact with a lamp body engagable with the lamp socket; a spring member fixed into the shockproof means; and a switching member having a lower part, an upper part which protrudes beyond a horizontal surface where at least one of the electrical contactors is located, and at least one protrusion with at least one side surface in slidable contact with one of the electrical contactors; and wherein the electrical contactors, electrical connectors and switching member are disposed in a spaced manner. A method for avoiding accidental electric shock during use of a lampholder is also disclosed.

24 Claims, 4 Drawing Sheets

SAFETY LAMPHOLDER AND METHOD FOR AVOIDING ACCIDENTAL ELECTRIC SHOCK CAUSED BY LAMPHOLDER

FIELD OF THE INVENTION

The invention relates to a safety lampholder for use in an illuminating lamp, more particularly to a safety lampholder which can take place of a commonly used lampholder for an illuminating lamp and is provided with an electrically shockproof means and to a method for avoiding accidental electric shock caused by a lampholder.

BACKGROUND OF THE INVENTION

Lampholders are widely used and generally have bayonet and screw types, the first one being matched with a bayonet bulb and the second one being matched with a screw bulb. There exists a potential risk of using such a lampholder in which metal parts are live when a bulb is not fixed into the lampholder and a power switch remains in the connected state. The lampholder is accessible to hands and fingers because it has a relatively large diameter, resulting in an electric shock accident.

Chinese Patent No. ZL91215869.7 provides a safety dual-purpose base for both screw and bayonet bulbs, which is provided with movable rods beneath positive and negative conducting pieces and with insulating washers above positive pole contact and bayonet negative pole contact. Chinese Patent No. ZL93225663.5 discloses a two-purpose anti-electroshock lamp base for screw and bayonet bulbs, which is fitted with an insulating washer between a conducting rod extending from the base and a spread spring so that the conducting rod is not in direct contact with positive and negative conducting pieces. Another safety dual-purpose base for both screw and bayonet bulbs is known from Chinese Patent No. ZL93226038.1, with an improvement in a bayonet slot of the base, the bayonet slot being formed as a rectangular slider capable of sliding within a bayonet trunk and having a lateral slot so that when a bayonet bulb is used, the bulb is fixedly inserted in the base. These lamp bases appear to achieve a safety purpose in light of the fact that the contacts are not live when bulbs are not fixed into these lamp bases. However, they still take a risk that an electric shock accident occurs. The accident will happen when a pressure generated by access to elastic metal parts or movable conducting rods with hands or fingers is high enough to cause downward movement of the metal parts or movable conducting rods to turn to an on-state.

International Application No. PCT/CN2003/000546 filed by the applicant relates to a kind of safety lampholder for avoiding accidental electric shock, comprising a screw or bayonet socket, a rooting plate, a conducting piece, an electrical contacting shaft with an round end, a pinpoint pole and a spring switch or a flexing member. The pinpoint pole is fixed in a center positioning base of the lampholder, and the spring switch or the flexing member causes the pinpoint pole to move up and down to form on/off state of a lamp circuit. When a bulb is fixed into the lampholder, the bulb makes the pinpoint pole downward till the spring contacts the pinpoint and the lamp circuit is conducting and the lamp works. When the bulb is removed from the lampholder, the pinpoint moves upward to be reset till the spring is depart from the pinpoint and the lamp circuit is disconnected. When people touch the pinpoint pole capable of moving down only if a given force is applied thereto, it can make people feel pain and stop pressing sequentially, whereby avoiding the accident. Obviously, this kind of safety lampholder is complicated in structure and a number of metal securing members are required for securing or holding the spring switch or flexing member and other parts. Further, a relatively large space is required because the spring moves the same distance as the pinpoint pole in the same direction. This results in complicated construction and high manufacturing costs of the lampholder. Also, the lampholder is of relatively large size and is thus not suitable for being fixed to a position where an ordinary type lampholder is fixed. Disadvantages of inconvenience of fixing the safety lampholder and high manufacturing cost of the safety lampholder make it difficult to be widely used in place of an ordinary type lampholder.

SUMMARY OF THE INVENTION

An object of the invention is to overcome the above-aforesaid disadvantages by providing a safety lampholder which is simple in structure and inexpensive to manufacture and is of generally same size as currently available lampholders.

According to the invention, the safety lampholder comprises an insulating housing; an insulating or electrically conductive lamp socket placed within one end of the housing; an electrically shockproof means fully integrated within another end of the housing, wherein the electrically shockproof means comprises two electrical connectors which are electrically coupled to a power supply; two electrical contactors which come into direct contact with a lamp body in engagement with the lamp socket, one contact at one end of at least one of the electrical contactors being movable resiliently and not directly electrically connected with the electrical connector corresponding thereto; a spring member fixed into a central portion of bottom of the electrically shockproof means; and a switching member having a lower part around which the spring member is fitted, an upper part which protrudes beyond a horizontal surface where at least one of the electrical contactors is located, and at least one protrusion with at least one side surface in slidable contact with one of the electrical contactors; and wherein the electrical contactors, the electrical connectors and the switching member are disposed in the electrically shockproof means in a spaced manner by use of a partition member.

According to the invention, the switching member is pushed by the lamp body engagable with the lamp socket to slidably push at least one of the electrical contactors by means of the side surface of the protrusion of the switching member in such a manner that the contact of the electrical contactor is electrically in contact with the electrical connector.

When the lamp body is removed from the lamp socket, the switching member is reset under action of the spring member; and the electrical contactors are separated from the electrical connectors under action of elasticity of the electrical contactors per se.

According to another aspect of the invention, a method for avoiding accidental electric shock during exchanging a lamp body or utilizing a lampholder is provided, comprising the steps of:

providing an insulating housing for a lampholder;

providing an insulating or electrically conductive lamp socket within one end of the housing for catering to a lampbody;

providing an electrically shockproof means within another end of the housing with which end the electrically shockproof means is fully integrated, wherein the electrically shockproof means comprises two electrical connectors which are electrically coupled to a power supply; two electrical contactors which come into direct contact with a lamp body in engagement with the lamp socket, one contact at one end of at least one of the electrical contactors being movable resiliently and not directly electrically connected with the electrical connector corresponding thereto; a spring member fixed into a central portion of bottom of the electrically shockproof means; and a switching member having a lower part around which the spring member is fitted, an upper part which protrudes beyond a horizontal surface where at least one of the electrical contactors is located, and at least one protrusion with at least one side surface in slidable contact with one of the electrical contactors; and disposing the electrical contactors, the electrical connectors and the switching member in the electrically shockproof means in a spaced manner by use of a partition member so that all accessible parts in the lampholder are not electriferous when the lampholder is electrically connected.

In one preferred embodiment of the invention, the switching member is configured to have cross-section of an airplane, having an upper part provided with one pinpoint portion; and two protrusions, each of which laterally extends from a respective side of the intermediate portion of the pole and further comprises at least one side surface, said side surface being in contact with the contactor in a slidable manner.

The invention features the electrically shockproof means of simple structure which can be fully integrated within the lampholder and has the switching member with one or more pinpoint portions. This shockproof means allows all accessible parts in the lampholder to be neutral when the lamp body is removed from the lampholder and has the ability of preventing the pinpoint pole from being depressed by people. So the lampholder of the invention can avoid an electric shock accident.

To have a better understanding of the invention reference is made to the following detailed description of the invention and embodiments thereof in conjunction with the accompanying drawings.

DETAILED DESCRIPTION OF THE INVENTION

Figure 1:
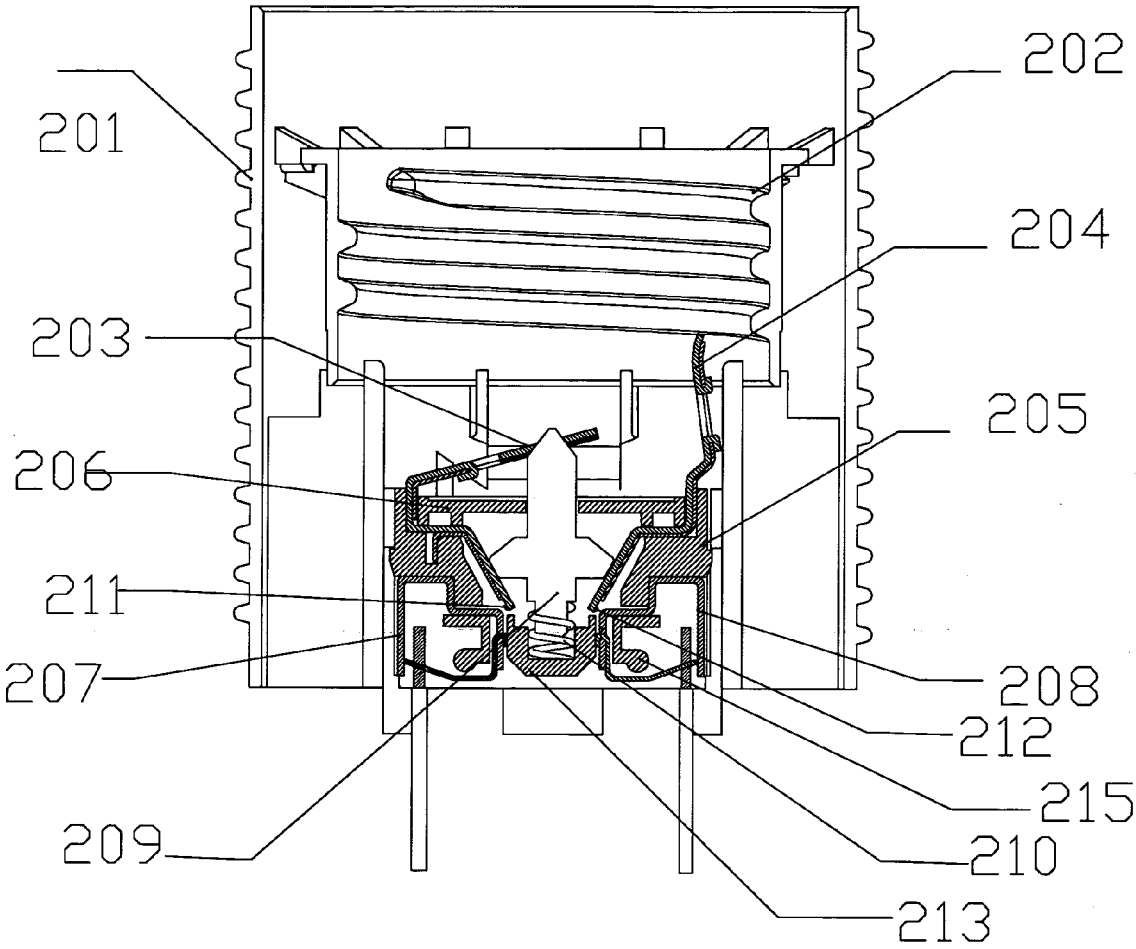
FIG. 1 is a sectional view of safety lampholder suitable for a screw bulb of a first preferred embodiment according to the invention.
Figure 2:
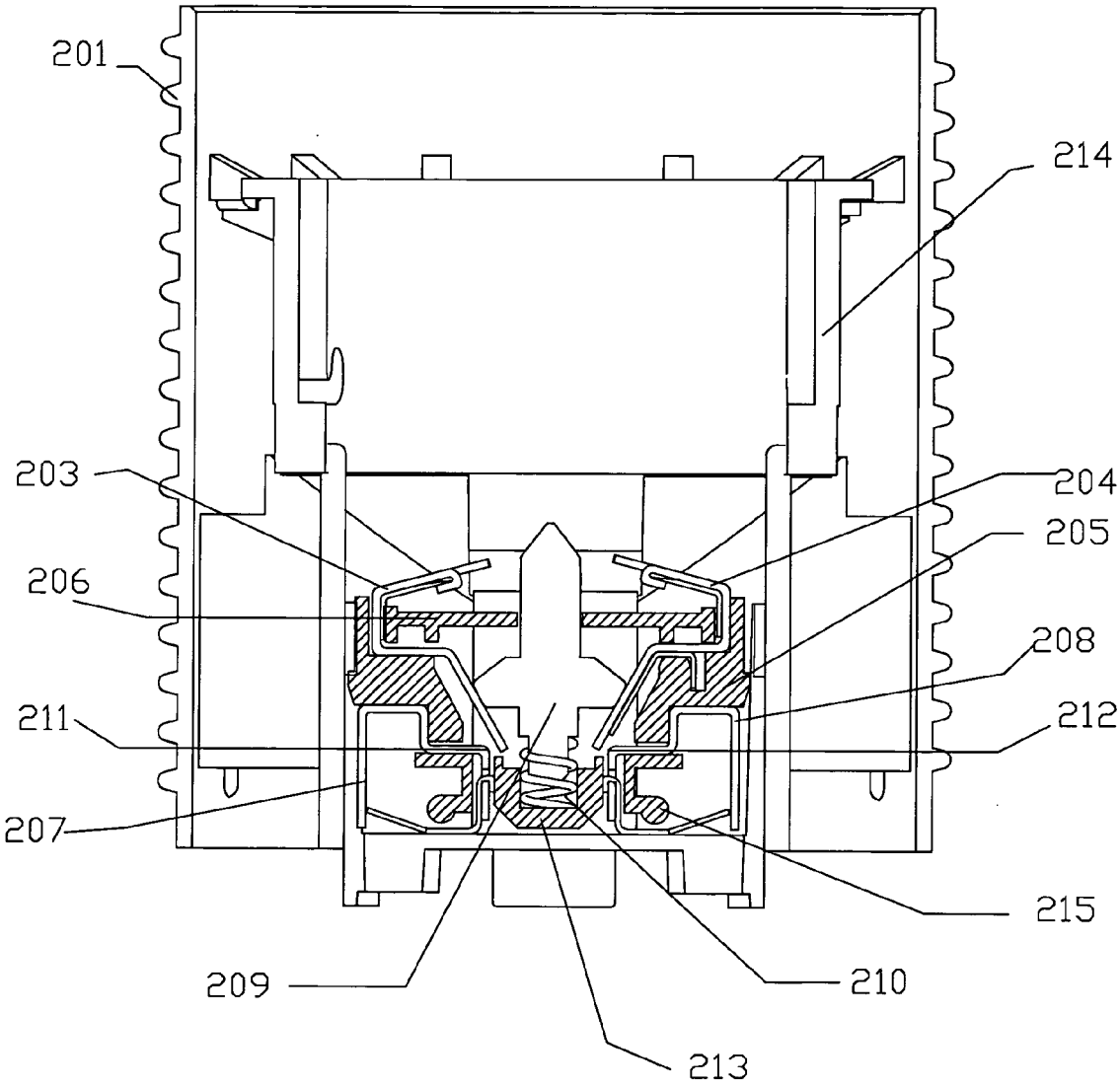
FIG. 2 is a sectional view of safety lampholder suitable for a bayonet bulb of a second preferred embodiment according to the invention.

Referring now to FIGS. 1 and 2, a safety lampholder suitable for a screw bulb and a safety lampholder suitable for a bayonet bulb are respectively provided consistent with first and second embodiments of the present invention.

In these embodiments, the safety lampholder comprises a housing 201, an insulating or electrically conductive lamp socket 202, 214 placed within one end of the housing 201; and an electrically shockproof means fully integrated within another end of the housing 201. The lampholder has few metal parts and permits the housing 201 which is of weigh and size substantially same as those of currently available lampholders. Preferably, the housing 201 is integrally made of insulating materials such as plastic materials, for example, by injection moulding process. More preferably, the lamp socket 202, 214 and the shockproof means are fully enclosed by the housing so that no electriferous part is exposed out of the housing in use.

FIG. 1 illustrates that the lamp socket 202 is mechanically secured. The lamp socket 202 is a screw sleeve with internal screw thread and made of insulating or electrically conductive materials and an insulating material is preferred for the invention. In the case that a conductive material is used, the screw sleeve may be made to come contact with electrical contactors of the shockproof means. FIG. 2 illustrates that the lamp socket 214 is a typical bayonet trunk made of an insulating material. It is understood that the lamp sockets 202, 214 of FIGS. 1 and 2, which are respectively suitable for a screw bulb and a bayonet bulb, are shown for the illustrative purpose. Many modifications on the basis of the disclosures of the invention to cater for bulbs of other types are within the ability of a person with ordinary skills in the art.

The electrically shockproof means is fully integrated within one end of the housing 201, comprising two electrical connectors 207, 208 which are electrically coupled to a power supply; two electrical contactors 203, 204 which come into direct contact with a lamp body in engagement with the lamp socket, each of the electrical contactors 203, 204 having at its one end one contact 211, 212 movable resiliently and not directly electrically connected with the electrical connector 207, 208 corresponding thereto; a spring member fixed into a central portion of bottom of the electrically shockproof means; and a profile switching member 209 having a lower part around which the spring member is fitted, an upper part which protrudes beyond a horizontal surface where at least one of the electrical contactors 203, 204 is located, and two protrusions each having one side surface in slidable contact with the corresponding electrical contactor 203, 204. In FIG. 1, the upper part protrudes beyond a horizontal surface where the electrical contactor 203 is located. In FIG. 2, the upper part protrudes beyond horizontal surfaces where the electrical contactors 203, 204 are respectively located. The electrical contactors 203, 204, the electrical connectors 207, 208 and the switching member 209 are disposed in the electrically shockproof means in a spaced manner by use of an insulating partition member so that on-off states are turned in response to fixing or removal of the lamp body.

In these embodiments, the partition member comprises a first partition part 206, a second partition part 205 and a third partition part 215.

As shown in FIGS. 1 and 2, the electric connectors are respectively a first metal conductive piece 207 and a second metal conductive piece 208 and secured within the shockproof means by use of the second partition part 205 and the third partition part 215 to be electrically coupled to a power supply. The electric contactors are respectively a first metal spring piece 203 and a second metal spring piece 204 and secured within the shockproof means by use of the first partition part 206 and the second partition part 205. The electrical contactors and the electrical connectors may form electric connection or disconnection.

In these embodiments, the end of each of the electric contactors 203, 204 having the contact 211, 212 extends obliquely within the shockproof means so that the electric contactor 203, 204 has a movement distance same as or different from the switching member 209. This provides the convenience of adjusting the size of the lampholder for a special application. The electric contactor 203, 204 may be made of a material such as metal materials having elastic and conductive characteristics in response to movement and resetting operations of the switching member 209. Alternatively, the electric contactor may be made of a material having good elastic characteristic and a material having good conductive characteristic. It is shown in FIGS. 1 and 2 that each of the electric contactor 203, 204 is constructed by a conductive piece having good elasticity and a conductive piece having good conductivity, the conductive pieces being disposed in abutment against each other. The two conductive pieces are arranged such that the one having good conductivity is used to electrically connect the lamp body and the electric connectors, and the other having good elasticity is used to provide the electric contactor with elastic characteristic. It should be understood that the electric contactors 203, 204 may be made of a single material having both elastic and conductive characteristics.

A raised portion at one end of the electric contactor 203, 204 may be used as the contact 211, 212. As an alternative, a metal element or a weak magnetic conducting element attached to one end of the electric contactor 203, 204 by welding or adhesive may be used as the contact 211, 212. If a weak magnetic conducting element is used, a magnetic element with the same magnetism may be arranged on the electric connector 207, 208 so that the electric contactor 203, 204 keeps apart from the electric connector 207, 208 using magnetic repulsion.

The third partition part 215 and/or the second partition part 205 may be formed integrally with the shockproof means, whereby reducing the number of parts of the lampholder. In FIGS. 1 and 2, the first, second and third partition parts 206, 205, 215 define a compartment in which the switching member 209 and the spring member are arranged. Apart from having the ability of partitioning the electric contactors 203, 204, the first partition part 206 has an hole for allowing the upper part of the switching member 209 having one pinpoint portion to project outwardly from the first partition part 206 so that the upper part is displaceable in a longitudinal direction thereof. The hole is of a diameter slightly larger than a body diameter of the switching member 209 to prevent the switching member 209 from moving in a transverse direction thereof.

The switching member is a profiled element, comprising a pole having the upper part provided with one pinpoint portion. The upper part is conically shaped in these embodiments. Also, the upper part may be hemispherically shaped with a plurality of cones. The switching member further comprises two protrusions laterally extending from respective sides of the pole. The protrusion comprises one side surface which is parallel to a direction in which the end of the electrical contactor 203, 204 having the contact extends, thereby allowing achievement of contact between the whole of the side surface and the electric contactor 203, 204. It should be understood that the side surface may be not parallel to a direction in which the end of the electrical contactor 203, 204 having the contact extends, in this case, the side surface partially comes into contact with the electric contactor 203, 204 in a slidable manner. The switching member 209 also has two horizontal surfaces parallel to the first partition part 206 so that the switching member 209 is reset to abut against the first partition part 206 for the sake of locking and limiting movement of the switching member 209. That is, the switching member 209 is allowed to move upwards to a position where it is in abutment against the first partition part 206 under action of the spring member. This ensures that the switching member 209 is merely capable of moving in a longitudinal direction thereof and is not permitted to move transversely or drop out of the holding member 213.

The switching member 209 is of substantially airplane-shaped or cross-shaped in cross-section. The laterally extending protrusion is of substantially rectangular or circular or polygonal in cross-section, wherein the side surface in contact with the electric contactor is preferably generally parallel to the electric contactor so as to generate a contact surface as large as possible therebetween.

The spring member comprises a spring 210 and a holding member 213 for supporting the spring 210. Preferably, a spring with a considerable elasticity is used in the invention in order to overcome a pressure generated when people touch the lampholder. Other flexing elements may be used in place of the spring. The holding member 213 may be integrated with the lampholder. As shown in FIGS. 1 and 2, the holding member 213 is provided with a groove for facilitating fixation of the spring 210.

In the embodiments of the invention, when the lamp body is engaged with the lamp socket 202, the switching member is pushed by the lamp body to slidably push the electrical contactors 203, 204 through the side surfaces of the protrusions of the switching member 209 in such a manner that the contacts 211, 212 of the electrical contactors 203, 204 are electrically in contact with the electrical connectors 207, 208. The lamp circuit is conducting and the lamp works well.

When the lamp body is removed from the lamp socket 202, the switching member 209 is reset under action of the spring member, and the contacts 211, 212 of the electrical contactors 203, 204 are separated from the electrical connectors 207, 208 under action of elasticity of the electrical contactors 203, 204 per se, so that the electrical contactors 203, 204 are electrically disconnected with the electrical connectors 207, 208 and thus not electriferous. As a result, all accessible parts in the lampholder are neutral. Further, the pinpoint pole of the switching member 209 prevents people from pressing it downwards. So the present invention can avoid an electric shock accident.

In accordance with the invention, one of the electrical contactors 203, 204 optionally comes into direct contact with one of the electrical connectors 207, 208 in the electrically shockproof means. Likewise, the end of one of the electrical contactors 203, 204 having the contact optionally is in direct contact with one of the electrical connectors 207, 208. In the case that zero line of the power supply is well grounded, use of one contact 211, 212, which is movable resiliently and not directly electrically connected with the corresponding electrical connector 207, 208, is allowed in the lampholder of the invention.

Figure 3:
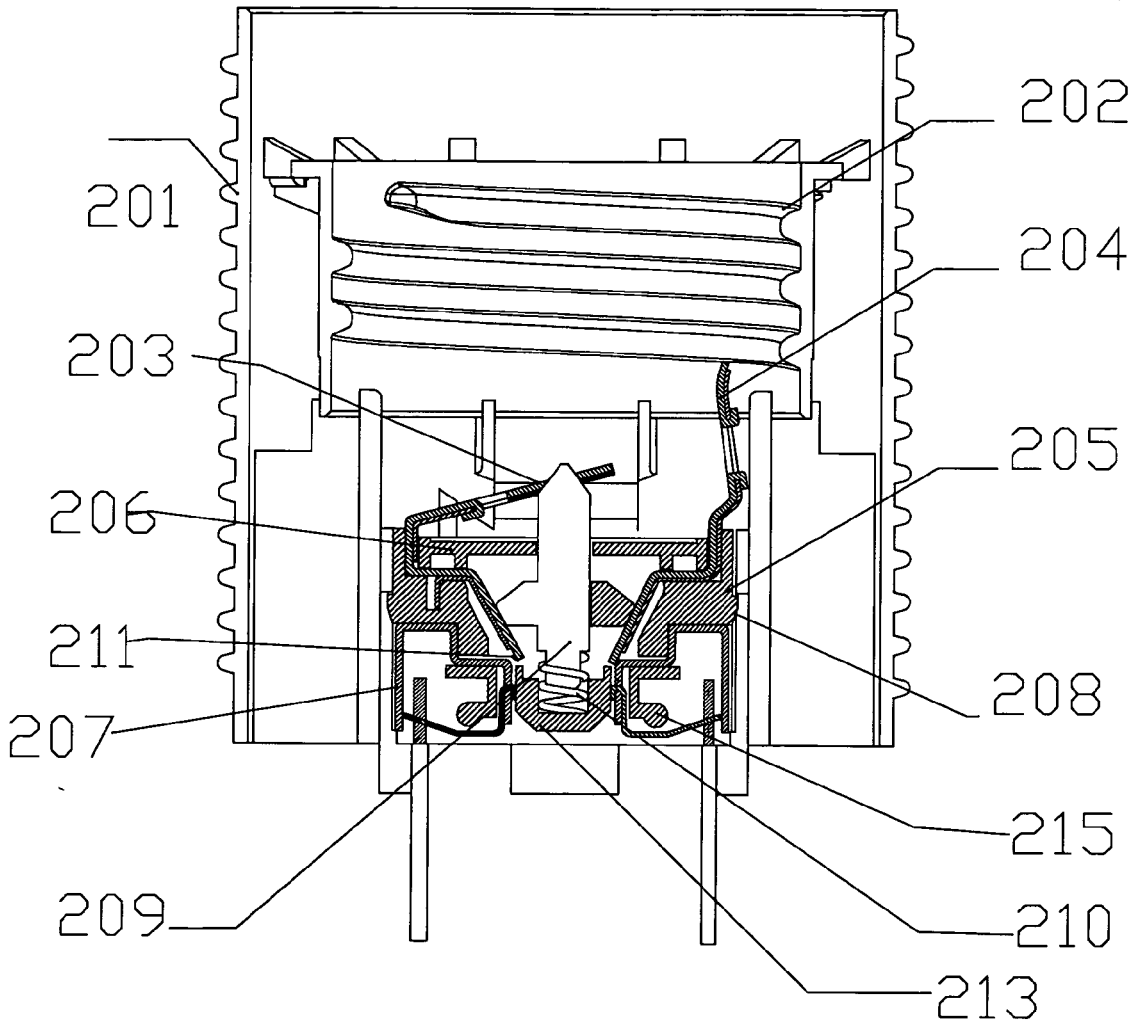
FIG. 3 is a sectional view of a variation of the safety lampholder of FIG. 1.
Figure 4:
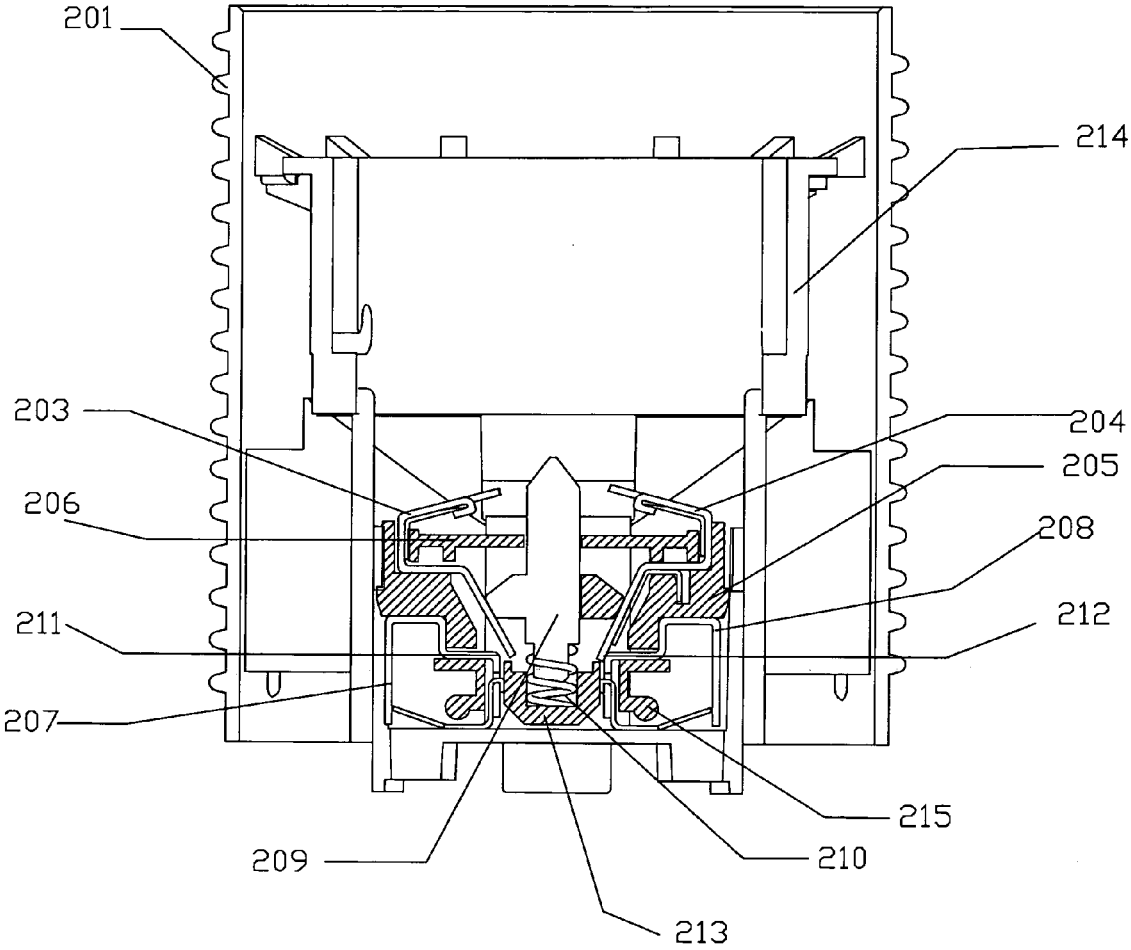
FIG. 4 is a sectional view of a variation of the safety lampholder of FIG. 2.

FIGS. 3 and 4 are respectively representative variations of the safety lampholders shown in FIGS. 1 and 2. In these variations, only one of the electrical contactors 203, 204 is in direct contact with the electric connector 207, 208 corresponding thereto; and the switching member 209 is configured in the same way as the one described in the above embodiments. It is known to a person skilled in the art that the switching member may be modified to other shapes as long as the requirement of existence of contact between one of the contactors 207, 208 and the switching member is satisfied.

The switching member 209 may be formed as a whole or with a part by use of conductive materials. Under such circumstances, the switching member 209 may be used as an electric contactor in direct contact with the lamp body. In the case that the switching member 209 is electrically conductive, other modifications may be made to the lampholder of the invention. For example, one of the electric contactors 203, 204 may be configured not to be exposed, and a surface of the other electric contactor with which the switching member 209 comes into contact may be coated with an insulating layer for the purpose of short circuit prevention. Also, the surfaces of the electric contactors 203, 204 with which the switching member 209 come into contact may be made of insulating elastic materials. All of these variations and modifications will fall into the scope of the present invention.

Another aspect of the invention provides a method for avoiding accidental electric shock during exchanging a lamp body or utilizing a lampholder, comprising the steps of:

providing an insulating housing for a lampholder;

providing an insulating or electrically conductive lamp socket within one end of the housing for catering to a lamp body;

providing an electrically shockproof means within another end of the housing with which end the electrically shockproof means is fully integrated, wherein the electrically shockproof means comprises two electrical connectors which are electrically coupled to a power supply; two electrical contactors which come into direct contact with a lamp body in engagement with the lamp socket, one contact at one end of at least one of the electrical contactors being movable resiliently and not directly electrically connected with the electrical connector corresponding thereto; a spring member fixed into a central portion of bottom of the electrically shockproof means; and a switching member having a lower part around which the spring member is fitted, an upper part which protrudes beyond a horizontal surface where at least one of the electrical contactors is located, and at least one protrusion with at least one side surface in slidable contact with one of the electrical contactors; and disposing the electrical contactors, the electrical connectors and the switching member in the electrically shockproof means in a spaced manner by use of a partition member so that all accessible parts in the lampholder are not electriferous when the lampholder is electrically connected.

The lampholders in the embodiments described hereinabove are preferred in this method.

As described above, one object of the invention is to provide a safety lampholder which is simple in structure and inexpensive to manufacture and is of generally same size as currently available lampholders. The method of the invention also ensures avoidance of an accidental electric shock during use of the lampholder, whereby providing protection for a user, particularly for a user who has poor knowledge of use of electric appliance or electric power.

It is understood that many other embodiments of the present invention are also possible, and many corresponding modifications as well as variations can be made by those skills in the art as according to the disclosure of the present invention and without departing from the spirits and essentials thereof, while such modifications and variations fall into the scope of the claims of the present invention.

What is claimed is:

1. A safety lampholder comprising:

an insulating housing;

an insulating or electrically conductive lamp socket placed within one end of the housing;

an electrically shockproof means fully integrated within another end of the housing;

wherein the electrically shockproof means comprises two electrical connectors which are electrically coupled to a power supply; two electrical contactors which come into direct contact with a lamp body in engagement with the lamp socket, one contact at one end of at least one of the electrical contactors being movable resiliently and not directly electrically connected with the electrical connector corresponding thereto; a spring member fixed into a central portion of bottom of the electrically shockproof means; and a switching member having a lower part around which the spring member is fitted, an upper part which protrudes beyond a horizontal surface where at least one of the electrical contactors is located, and at least one protrusion with at least one side surface in slidable contact with one of the electrical contactors; and wherein the electrical contactors, the electrical connectors and the switching member are disposed in the electrically shockproof means in a spaced manner by use of a partition member.

2. The safety lampholder as claimed in claim 1, wherein the switching member is pushed by the lamp body engagable with the lamp socket to slidably push at least one of the electrical contactors by means of the side surface of the protrusion of the switching member in such a manner that the contact of the electrical contactor is electrically in contact with the electrical connector.

3. The safety lampholder as claimed in claim 1, wherein when the lamp body is removed from the lamp socket, the switching member is reset under action of the spring member; and the electrical contactors are separated from the electrical connectors under action of elasticity of the electrical contactors per se.

4. The safety lampholder as claimed in claim 1, wherein the end of the contactor having the contact extends obliquely within the electrically shockproof means.

5. The safety lampholder as claimed in claim 1, wherein one of the electrical contactors optionally comes into direct contact with one of the electrical connectors in the electrically shockproof means.

6. The safety lampholder as claimed in claim 5, wherein the end of the contactor having the contact optionally comes into direct contact with one of the electrical connectors in the electrically shockproof means.

7. The safety lampholder as claimed in claim 5, wherein one of the electrical contactors is in slidable contact with the switching member.

8. The safety lampholder as claimed in claim 6, wherein one of the electrical contactors is in slidable contact with the switching member.

9. The safety lampholder as claimed in claim 1, wherein the switching member comprises a pole having an upper part provided with one or more pinpoint portions; and two protrusions, each of which laterally extends from a respective side of the pole and comprises at least one side surface, said side surface being in contact with the contactor in a slidable manner.

10. The safety lampholder as claimed in claim 1, wherein the switching member is formed as a whole from insulating materials.

11. The safety lampholder as claimed in claim 1, wherein the switching member is formed as a whole or with a part from electrically conductive materials.

12. The safety lampholder as claimed in claim 11, wherein the switching member is used as an electrical contactor in direct contact with the lamp body.

13. The safety lampholder as claimed in claim 12, wherein the end of the switching member in direct contact with the lamp body is movable resiliently and is not directly electrically connected with the electrical connector corresponding thereto.

14. The safety lampholder as claimed in claim 1, wherein the electrical contactor is made of a material having elastic and conductive characteristics.

15. The safety lampholder as claimed in claim 1, wherein the electrical contactor is made of a material having good elastic characteristic and a material having good conductive characteristic.

16. The safety lampholder as claimed in claim 1, wherein the partition member comprises a first partition part for partitioning and securing the electrical contactors and the electrical connectors; and a second partition part for partitioning and securing the electrical contactors and the switching member.

17. The safety lampholder as claimed in claim 16, wherein the partition member further comprises a third partition part for partitioning and securing the electrical contactors and the electrical connectors.

18. The safety lampholder as claimed in claim 17, wherein the second partition part is made integrally with the third partition part.

19. The safety lampholder as claimed in claim 1, wherein the electrical contactor is a spring piece.

20. The safety lampholder as claimed in claim 1, wherein the spring member comprises a spring or other flexing elements and a holding member for supporting the spring or the flexing elements.

21. The safety lampholder as claimed in claim 1, wherein the switching member is movably mounted by use of the spring member in a compartment of the electrically shockproof means defined by the partition member.

22. The safety lampholder as claimed in claim 16, wherein the switching member is movably mounted by use of the spring member in a compartment of the electrically shockproof means defined by the first and second partition parts.

23. A method for avoiding accidental electric shock during exchanging a lamp body or utilizing a lampholder, comprising:

providing an insulating housing for a lampholder;

providing an insulating or electrically conductive lamp socket within one end of the housing for catering to a lamp body;

providing an electrically shockproof means within another end of the housing with which end the electrically shockproof means is fully integrated, wherein the electrically shockproof means comprises two electrical connectors which are electrically coupled to a power supply; two electrical contactors which come into direct contact with a lamp body in engagement with the lamp socket, one contact at one end of at least one of the electrical contactors being movable resiliently and not directly electrically connected with the electrical connector corresponding thereto; a spring member fixed into a central portion of bottom of the electrically shockproof means; and a switching member having a lower part around which the spring member is fitted, an upper part which protrudes beyond a horizontal surface where at least one of the electrical contactors is located, and at least one protrusion with at least one side surface in slidable contact with one of the electrical contactors; and disposing the electrical contactors, the electrical connectors and the switching member in the electrically shockproof means in a spaced manner by use of a partition member so that all accessible parts in the lampholder are not electriferous when the lampholder is electrically connected.

24. The method as claimed in claim 22, wherein the lampholder as claimed in claim 1 is used.

* * * * *